United States Patent [19]

Richards

[11] Patent Number: 4,545,864

[45] Date of Patent: Oct. 8, 1985

[54] SELECTIVE PLATING

[75] Inventor: Michael A. Richards, Delapre, England

[73] Assignee: S.G. Owen Limited, Northampton, England

[21] Appl. No.: 538,655

[22] Filed: Oct. 3, 1983

[30] Foreign Application Priority Data

Oct. 5, 1982 [GB] United Kingdom ..... 8228379

[51] Int. Cl.[4] ..... C25D 5/02

[52] U.S. Cl. ..... 204/15; 427/123; 427/125; 427/282

[58] Field of Search ..... 204/15, 224 R, 18.1; 427/123, 287, 125, 282, 304, 424; 118/301

[56] References Cited

U.S. PATENT DOCUMENTS

| | | | |
|---|---|---|---|
| 4,001,093 | 1/1977 | Koontz et al. | 204/15 |
| 4,029,555 | 6/1977 | Tezuka et al. | 204/15 |
| 4,340,449 | 7/1982 | Spinivasan et al. | 204/15 |
| 4,414,075 | 11/1983 | Cockeram | 204/15 |

FOREIGN PATENT DOCUMENTS 372631 5/1932 United Kingdom

OTHER PUBLICATIONS

Bigge and Graham, "Design for Plating", from *Electroplating Engineering Handbook,* 3rd. Edition 1971, A. K. Graham, pp. 56-65.

*Primary Examiner*—Norman Morgenstern
*Assistant Examiner*—Ken Jaconetty
*Attorney, Agent, or Firm*—Spencer & Frank

[57] ABSTRACT

A method of selective plating a component, which method comprises contacting a lower face of the component with a contoured lower mask having a plating aperture so as to expose an area of the component to be plated, positioning the component over a plating tank and selective plating the component with a plating medium, wherein the cross-sectional area of the plating aperture is enlarged at the surface of the component so as to define one or more cavities in which the plating rate is lower than elsewhere in the plating aperture.

13 Claims, 4 Drawing Figures

SELECTIVE PLATING

BACKGROUND OF THE INVENTION

THIS INVENTION relates to selective plating, in particular the selective plating of components such as connectors with electrodepositable metals and alloys such as gold.

In order to achieve specified thickness of precious (or other) metal plated at defined points on the contact face in selective plating, an excessive thickness is often plated outside these points, thus wasting precious metal. This is the result of current density distribution which in turn depends on the design of the electrolytic cell.

SUMMARY OF THE INVENTION

It is an object of the present invention to enable the provision of a method of selective plating whereby the above disadvantage may be overcome or at least mitigated.

Accordingly, the present invention provides a method of selective plating a component, which method comprises contacting the component with a mask so as to expose an area to be plated and plating the said area, wherein the shape of the mask is such that the plating rate is not the same at all points on the said area, as well as a component whenever plated using the method and a mask for use in the method. Preferably, a contoured bottom mask is used so that a cavity or cavities are produced in which a lower plating rate is achieved. Advantageously, the contoured bottom mask comprises a silicone rubber or plastics material having a hardness of at least about 70° shore.

In a preferred aspect, the present invention provides a method of selective plating a component, which method comprises contacting a lower face of the component with a lower mask having a plating aperture so as to expose an area of the component to be plated, positioning the component over a plating tank and selective plating the component, wherein the cross-sectional area of the plating aperture is enlarged at the surface of the component so as to define or more cavities in which the plating rate is lower than elsewhere in the plating aperture.

The method of the present invention may be used in any suitable selective plating machine, such as the "Carousel" type selective plating machine of S. G. Owen Limited, which is in commercial use in the United Kingdom and the United States of America, or a machine for selective plating components on a reel wherein the reel is indexed in plating heads sliding on tracks over a plating tank, each plating head comprising a lower mask for exposing a selected portion of each component to electrolyte and means for releasably sealing the rear of the reel during plating. A machine of the latter type is described and illustrated in U.S. Pat. No. 4,414,075 (Cockeram). Apart from the simultaneous dual thickness plating of the present invention, plating is effected in the conventional manner utilising, for example, an appropriate one of the commercially available plating solutions. A suitable current density for gold plating connectors in the "Carousel" type selective plating machine is about 20 amp/dm$^2$ (2,000 amp/m$^2$) of cathode interface.

The method of the present invention can be used to plate with any electrodepositable metal or alloy. However, it is envisaged that the method will be of particular utility in plating with relatively expensive metals such as gold or the platinum group of metals such as palladium, ruthenium and rhodium. Taking, as an example, the 206D connector as specified by British Telecom or the 946 range of connectors of the Western Electric Co. in the United States of America, and assuming a current market at 180 million units per annum, it is estimated that a cost saving in gold of about US$8 million could be achieved in a year (gold at US$414 per Troy oz) using the method of the present invention.

Thus, the present invention enables the production of precious metal cost savings in selective plating by means of achieving a controlled thickness distribution over a contact surface. This will ensure that specified thicknesses are met, without excessive metal being plated elsewhere on the face. In one aspect of the invention, the geometry of the mini-electrolytic cell present as multiple units in a selective plating head is modified using a contoured bottom mask.

DESCRIPTION OF PREFERRED EMBODIMENTS

Figure 1:
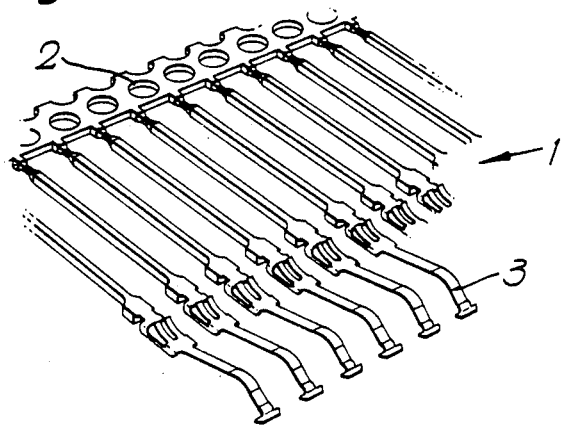
FIG. 1 is a perspective view of connectors to be plated.

Referring now to the drawings, connectors 1 are joined to form a reel having sprocket holes 2. A portion 3 of one face of each connector is to be selective plated with gold. The reel is indexed in a plating head 4 by means of pins 5 of the plating head 4 which locate in the sprocket holes 2. The plating head 4 comprises track lines 6, rollers 7 and a spring loaded lid 8 which is biased into the open position. The track lines 6 and rollers 7 ride on tracks 9 and walls 10, respectively, of a plating tank 11 which also comprises wiers 12, an anode 13 and an elongate slot jet 14. As the plating head 4 enters the plating zone the lid 8 is closed by means of a roller 15 mounted thereon so as to grip the connectors 1 between an upper mask 16 and a lower, contoured, mask 17.

The upper mask 16 is mounted in the underside of the lid 8 and may, for example, comprise a resilient pad of foam rubber or a deformable upper mask of silicone rubber having a hardness of from 12° to 20° shore which will deform under pressure so as at least partially to mask the exposed edges of the connectors 1. The specially-moulded contoured lower mask 17 is mounted on the track lines 6 and comprises a silicone rubber having a hardness of 70° to 80° shore. The lower mask 17 presents a selected length of each connector 1 to the elongate slot jet 14 during plating (which is carried out with the plating head 4 stationary), whilst the upper mask 16 masks the upper face and, optionally, the edges of each connector.

Figure 2:
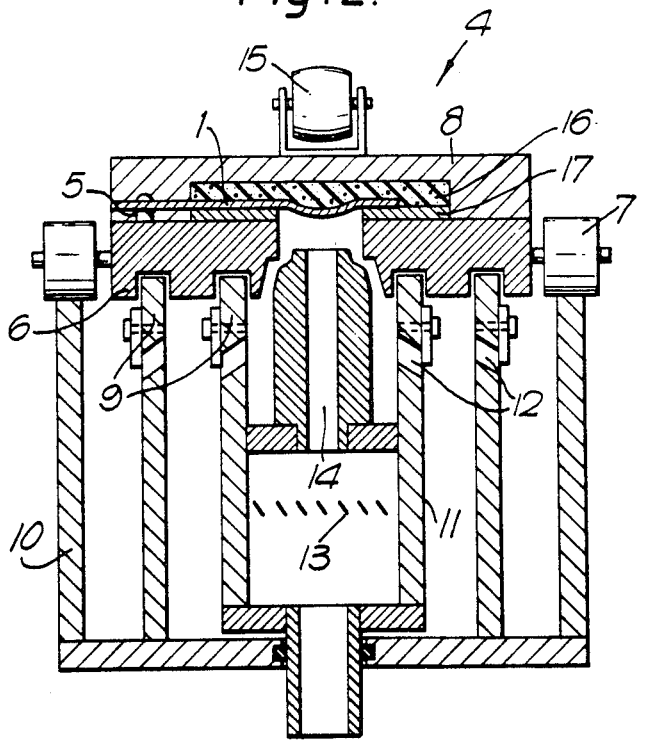
FIG. 2 is a vertical sectional view of a plating head having the connectors of FIG. 1 indexed therein.
Figure 3:
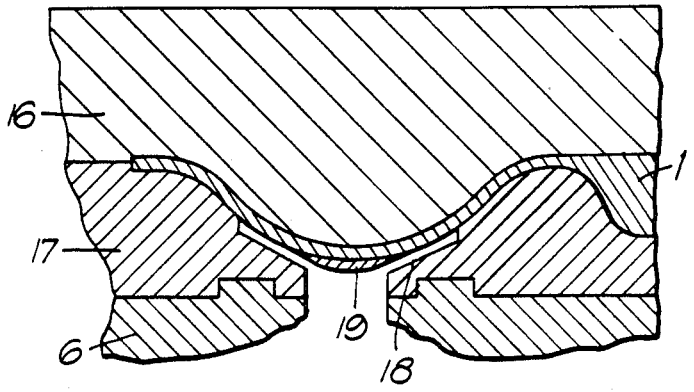
FIG. 3 is a partial vertical sectional view of the plating head of FIG. 2 with a first bottom mask in position.
Figure 4:
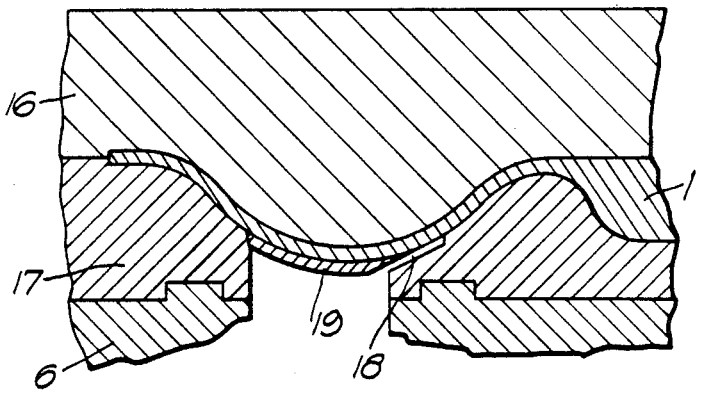
FIG. 4 is a partial vertical sectional view of the plating head of FIG. 2 with a second bottom mask in position.

Referring now to FIGS. 3 and 4, the shaping of the lower mask 17 is such that cavities 18 are produced in which a lower plating rate is achieved. Thus, a smaller thickness of plating medium 19—in this case gold—can be produced at both ends (FIG. 3) or only one end (FIG. 4) of the contact face, depending on the specification used. The thickness of the electrodeposited gold layer is typically 3 μm. The plating head of FIG. 2 could, of course, also be utilized when plating lead frames or strip metal in accordance with the present invention.

Although particular embodiments of the invention have been described and illustrated herein, it is recognized that modifications may readily occur to those skilled in the art and consequently it is intended that the following be claims interpreted to cover such modifications and equivalents.

What is claimed is:

1. A method of selectively jet-plating a component, which method comprises contacting the component with a mask so as to expose an area to be plated and selectively jet-plating the said area, wherein the shape of the mask is such that the plating rate is not the same at all points on the said area.

2. A method according to claim 1, wherein the mask has a plating aperture of non-uniform cross section, whereby one or more cavities are produced in which the plating rate is lower than elsewhere in the plating aperture.

3. A method according to claim 1 wherein the mask comprises a silicone rubber.

4. A method according to claim 1 wherein the mask comprises a material having a hardness of at least about 70° shore.

5. A method according to claim 4, wherein the said material has a hardness of from 70° to 80° shore.

6. A method according to claim 1 wherein the component is selective plated with gold.

7. A method of selectively jet-plating a component, which method comprises contacting the component with a mask so as to expose an area to be plated and selectively jet-plating the said area, wherein the shape of the mask is such that the plating rate is not the same at all points on the said area, and wherein the component is a connector.

8. A method of selectively jet-plating a component, which method comprises contacting a lower face of the component with a lower mask having a plating aperture so as to expose an area of the component to be plated, positioning the component over a plating tank and selectively jet-plating the component, wherein the cross-sectional area of the plating aperture is enlarged at the surface of the component so as to define one or more cavities in which the plating rate is lower than elsewhere in the plating aperture.

9. The method according to claim 1, wherein said component is an electrical component.

10. The method according to claim 1, wherein said component is an electrical connector.

11. The method according to claim 1, wherein said component is an elongated electrical connector having an axis, wherein said mask comprises a material having a hardness of at least about 70° shore and has a plating aperture of non-uniform cross section, whereby at least one cavity is produced in which the plating rate is lower than elsewhere in the plating aperture, and wherein said step of selectively jet-plating the said area comprises directing a jet of electrolyte through said plating aperture toward said component and substantially perpendicular to said axis thereof.

12. A method according to claim 7, wherein said connector is an electrical connector.

13. A method according to claim 8, wherein said component is an electrical connector.

* * * * *